US007484993B2

(12) United States Patent
Amidon et al.

(10) Patent No.: US 7,484,993 B2
(45) Date of Patent: Feb. 3, 2009

(54) ETHERNET CABLE CONNECTOR AND METHODS OF USE THEREOF

(75) Inventors: Jeremy Amidon, Marcellus, NY (US); Stephen P Malak, Manlius, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/696,860

(22) Filed: Apr. 5, 2007

(65) Prior Publication Data

US 2007/0178722 A1 Aug. 2, 2007

Related U.S. Application Data

(63) Continuation-in-part of application No. 11/377,596, filed on Mar. 16, 2006, now Pat. No. 7,201,604.

(51) Int. Cl.
*H01R 13/58* (2006.01)

(52) U.S. Cl. ..... 439/469; 439/418; 439/460

(58) Field of Classification Search ..... 439/417, 439/418, 395, 346, 404, 469, 460
See application file for complete search history.

(56) References Cited

U.S. PATENT DOCUMENTS

| | | | | |
|---|---|---|---|---|
| 4,969,839 | A | 11/1990 | Nilsson | |
| 5,599,202 | A | 2/1997 | Key | |
| 6,116,952 | A | 9/2000 | Nakata | |
| 6,162,085 | A | 12/2000 | Chugh et al. | |
| 6,193,539 | B1 | 2/2001 | Chang | |
| 6,332,802 | B2 * | 12/2001 | Hirokawa | 439/418 |
| 6,368,129 | B1 | 4/2002 | Wang et al. | |
| 6,402,545 | B1 * | 6/2002 | Huang | 439/418 |
| 6,764,333 | B2 * | 7/2004 | Pocrass | 439/418 |
| 7,001,204 | B1 * | 2/2006 | Lin | 439/418 |
| 7,048,563 | B2 | 5/2006 | Fukuda et al. | |
| 7,070,443 | B2 | 7/2006 | Tashiro et al. | |
| 2002/0055294 | A1 * | 5/2002 | Murakami et al. | 439/395 |
| 2004/0127088 | A1 * | 7/2004 | Yuan | 439/404 |
| 2004/0259411 | A1 * | 12/2004 | Chen | 439/418 |
| 2005/0106929 | A1 * | 5/2005 | Meckley et al. | 439/418 |
| 2008/0064251 | A1 * | 3/2008 | Amidon | 439/418 |

FOREIGN PATENT DOCUMENTS

GB 2104307 A * 3/1983

* cited by examiner

*Primary Examiner*—T C Patel
*Assistant Examiner*—Harshad C Patel
(74) *Attorney, Agent, or Firm*—Schmeiser, Olsen & Watts

(57) ABSTRACT

An ethernet cable connector for coupling an ethernet cable and providing contact between insulated wires of the ethernet cable and insulation displacement contacts within the connector. The connector includes an inner body having a clamp, a plurality of holes and a plurality of recesses transverse to the plurality of holes. Each hole receives a wire of an ethernet cable. The outer body is operatively coupled to the inner body and is configured to couple insulation displacement contacts within the outer body. The insertion of the inner body within the outer body bends the wires of the ethernet cable to rest within the plurality of recesses of the inner body, engages the insulation displacement contacts with the ethernet wires and compresses the clamp around a portion of the ethernet cable, thereby providing strain reduction to the ethernet wires.

14 Claims, 10 Drawing Sheets

ETHERNET CABLE CONNECTOR AND METHODS OF USE THEREOF

RELATED APPLICATION

This application is a continuation-in-part of U.S. patent application Ser. No. 11/377,596, filed on Mar. 16, 2006, currently pending.

BACKGROUND OF INVENTION

1. Technical Field

This invention relates generally to the field of connectors for use with an ethernet cable. More particularly, this invention provides for a connector having an inner body insertable within an outer body to make secure mechanical and electrical contact with the wires of the ethernet cable.

2. Related Art

Heretofore, connectors for use with ethernet cables require the wires of the cable to be fed the entire length of the connector. Further, typical connectors pinch an ethernet cable with a bar to hold the cable inside the connector.

Two problems arise from this method of coupling a connector to an ethernet cable. First, feeding the wires the length of the connector make it difficult to maintain a twisted configuration of the ethernet wires, which configuration is common among all ethernet cables. Second, the use of a bar to pinch the ethernet cable only secures the cable at one point. This pinching of the cable at one point leads to problems of retaining the cable in secure connection with the connector and further problems with strain relief from the contacts.

Accordingly, there is a need in the field of connectors for use with ethernet cables for an improved connector.

SUMMARY OF INVENTION

The present invention provides an ethernet cable connector that uses an inner body for coupling to an ethernet cable, the inner body being inserted into an outer body to contact insulation displacement contacts coupled within the outer body.

A first general aspect of the invention provides a connector for coupling an end of an ethernet cable, the connector comprising: an inner body having a first end and second opposing end, the second end having a plurality of holes and a plurality of recesses transverse to the plurality of holes, each hole receiving an insulated wire of an ethernet cable and each recess corresponding to a single hole; and an outer body, operatively coupled to the inner body, the outer body having a first end and second opposing end, the first end having a recess and the second end configured to couple insulation displacement contacts within the outer body, the recess of the first end of the outer body configured to receive the inner body, wherein the insertion of the inner body within the outer body bends the wires of the ethernet cable to rest within the plurality of recesses of the inner body and engages the insulation displacement contacts with the ethernet wires.

A second general aspect of the invention provides a connector for coupling an end of an ethernet cable, the connector comprising: an inner body having a first end and second opposing end, the first end having a clamp and the second end having a plurality of holes and a plurality of recesses transverse to the plurality of holes, each hole receiving a wire of an ethernet cable and each recess corresponding to a single hole; and an outer body, operatively coupled to the inner body, the outer body having a first end and second opposing end, the first end having a recess and the second end configured to couple insulation displacement contacts within the outer body, the recess of the first end of the outer body configured to receive the inner body, wherein the insertion of the inner body with the outer body bends the wires of the ethernet cable to rest within the plurality of recesses of the inner body, engages the insulation displacement contacts with the ethernet wires and compresses the clamp around a portion of the ethernet cable securely retaining the cable in a position configured to reduce strain on the ethernet wires.

A third general aspect of the present invention provides an ethernet cable connector comprising: an inner body; an outer body configured to receive the inner body; and means for coupling an ethernet cable to the inner body, wherein the means reduce strain on wires of the ethernet cable when the inner body is received by the outer body.

A fourth general aspect of the present invention provides a method of coupling a connector to an end of an ethernet cable, the method comprising the steps of: providing a connector, said connector having an inner body and an outer body; inserting insulated ethernet wires into holes of the inner body of the connector; removing excess wire; inserting the inner body of the connector into the outer body of the connector, wherein the action of inserting the inner body into the outer body of the connector includes bending a portion of the insulated ethernet wires into a transverse position to rest within recesses and compressing a clamp of the inner body onto the ethernet cable; and engaging the ethernet wires with insulation displacement contacts when the inner body is inserted into the outer body.

A fifth general aspect of the present invention provides a connector for coupling an end of an ethernet cable having twisted wire pairs, the connector comprising: an inner body having a first end and a second opposing end, the second end having a guide member located proximate a series of access apertures extending through a front face of the inner body, and the first end having a clamp; an outer body, having a first end and a second opposing end, the first end having an opening configured to receive the inner body; and insulation displacement contacts located within the outer body proximate the second end of the outer body; wherein, when the inner body is inserted into the outer body, the clamp closes around the ethernet cable and the insulation displacement contacts extend through the access apertures and pierce the wires of the twisted wire pairs, to make electrical contact therewith, as the wires are aligned vertically against the guide member.

A sixth general aspect of the present invention provides an ethernet cable connector comprising: an outer body having an opening configured to receive an inner body; wherein insertion of the inner body into the outer body compresses two clamping portions of the inner body against the ethernet cable; and wherein wires of the ethernet cable wrap partially around a guide member of the inner body and make electrical contact with insulation displacement contacts (IDC's) located inside the outer body when the inner body is inserted within the outer body.

A seventh general aspect of the present invention provides an ethernet cable connector comprising: an inner body; an outer body configured to receive the inner body; and means for attaching the ethernet cable to the connector, wherein the means utilize an orientation of ethernet cable wires wrapped at least partially around at least one component of the inner body to firmly hold the cable in the connector.

An eighth general aspect of the present invention provides a method of retaining an ethernet connector in an ethernet cable connector, the method comprising: providing an ethernet cable connector, the connector including: an outer body configured to receive an inner body, the inner body having a guide member and a compressible cable clamp; wrapping wires of the ethernet cable partially around the guide member so that the wires reside below the guide member and run vertically between the guide member and a front face of the inner body; and inserting the inner body into the outer body so that the insertion thereof bends the wires over the top of the guide member and compresses the clamp of the inner body against to cable to retain the cable within the connector.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
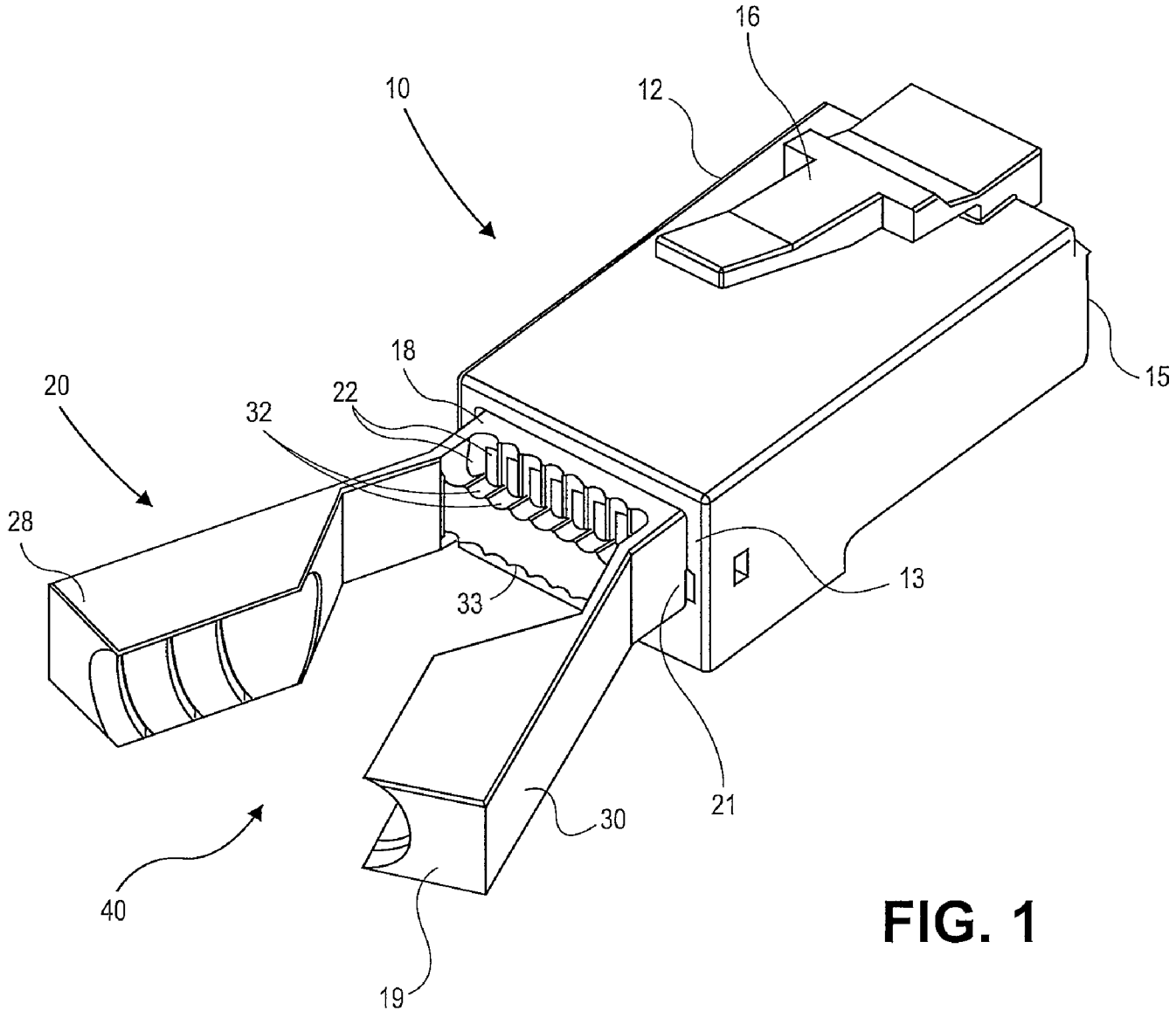
FIG. 1 depicts a perspective view of an embodiment of an ethernet cable connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an" and "the" include plural referents, unless the context clearly dictates otherwise.

Figure 2:
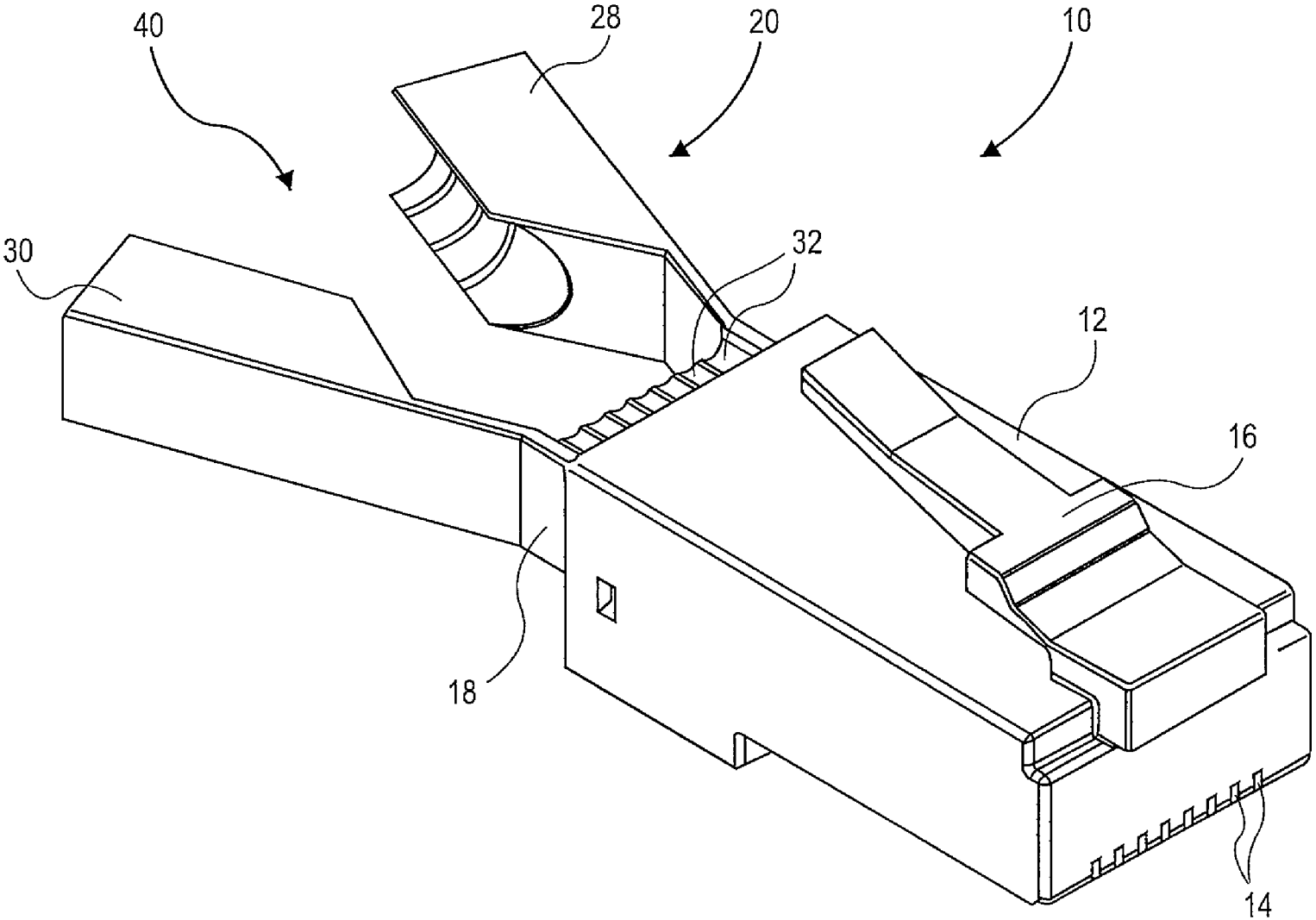
FIG. 2 depicts another perspective view of the embodiment of the ethernet cable connector of FIG. 1, in accordance with the present invention.

Referring to the drawings, FIGS. 1 and 2 depict one embodiment of an ethernet cable connector 10. The connector 10 may include an outer body 12 and an inner body 18. The inner body 18 may have a first end 19 and second opposing end 21, the second end 21 having a plurality of holes 22 and a plurality of recesses 32 transverse to the plurality of holes 22, each hole 22 receiving an insulated wire of an ethernet cable and each recess 32 corresponding to a single hole 22. Further the second end may include bottom recesses 33, each bottom recess 33 corresponding to a single hole 22. The first end 19 of the inner body 18 may include a clamp 20. The clamp 20 may include a first clamp portion 28, a second opposing clamp portion 30 and a central passageway 40 between the first and second portions 28 and 30, wherein the passageway is configured to receive a portion of an ethernet cable.

It will be understood by those of ordinary skill in the art that the plurality of holes 22 may be in various forms, such as, but not limited to, individual holes, a single slot with grooves separating hole portions for each wire and any combination thereof. Further the individual holes and/or the grooves may be of any shape, such as, but not limited to a circle, a rectangle, a square, a triangle, an oval or any other shape so long as the hole has sufficient size to receive an ethernet cable wire.

It will further be understood by those of ordinary skill in the art that the plurality of recesses 32 corresponding to the holes 22 may also be of any shape, such as, but not limited to a circle, a rectangle, a square, a triangle, an oval or any other shape so long as the hole has sufficient size to receive an ethernet cable wire. Additionally, the recesses 32 may be adjacent to the holes 22 or at a certain distance from the holes 22, so long as the recesses receive the wires and are able to isolate each wire from the others to avoid contact between wires.

The outer body 12 is operatively coupled to the inner body 18, the outer body 12 having a first end 13 and second opposing end 15, the first end 13 having a recess or opening and the second end 15 configured to couple insulation displacement contacts (IDC's) 14 within the outer body 12. The recess or opening of the first end 13 of the outer body 12 may be configured to receive the inner body 18, wherein the insertion of the inner body 18 within the outer body 12 bends the wires of an ethernet cable to rest within the plurality of recesses 32 of the inner body 18 and engages the IDC's 14 with the ethernet wires.

Figure 3:
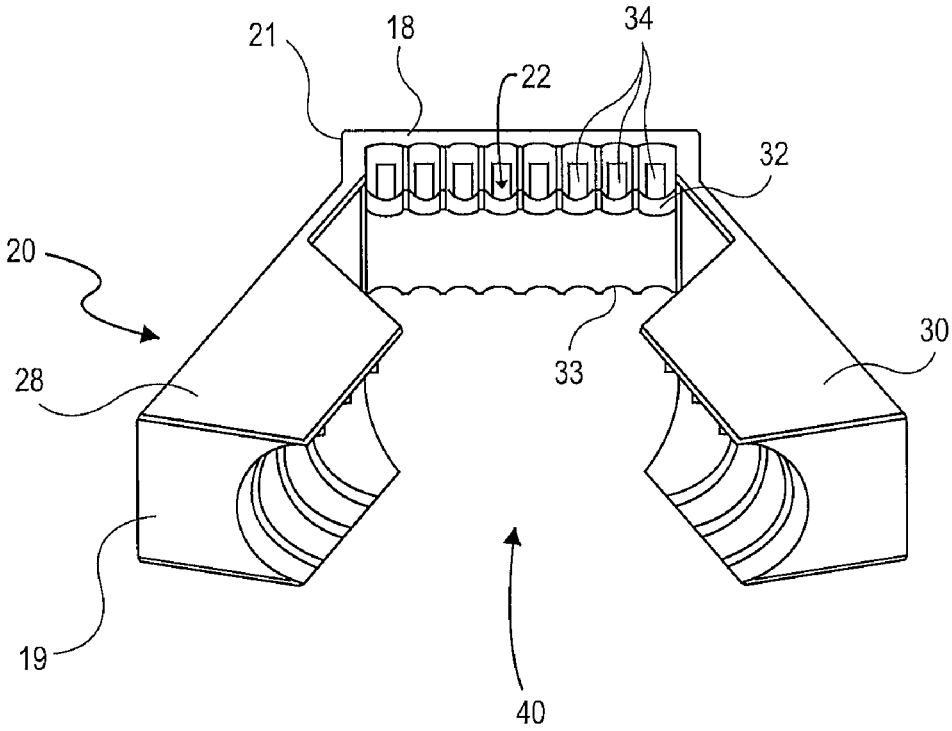
FIG. 3 depicts a perspective view of an embodiment of an inner body of an ethernet cable connector, in accordance with the present invention.

Referring further to the drawings, FIG. 3 depicts an embodiment of the inner body 18 in accordance with the present invention. The inner body 18 may have a first end 19 and second opposing end 21, the second end 21 having a plurality of holes 22 and a plurality of recesses 32 transverse to the plurality of holes 22 Each recesses 32 may correspond to a single hole 22. Each hole 22 receives an insulated wire of an ethernet cable. As the wires extend through the holes 22, the wires may be bent and rest within the recesses 32. The second end 21 may further include bottom recesses 33. The bottom recesses 33 may be transverse to the holes 22 with each bottom recess 33 corresponding to a single hole 22. The bottom recesses 33 may receive a portion of the insulated wires allowing the ethernet cable to extend in a transverse direction away from the holes 22. The second end 21 of the inner body 18 may further include a plurality of access apertures 34, wherein each access aperture 34 corresponds to a single hole 22 of the plurality of holes 22 to provide access to the ethernet wires for engagement with the IDC's 14.

The first end 19 of the inner body 18 may include a clamp 20 for clamping an ethernet cable, the clamp 20 including a first clamp portion 28, a second opposing clamp portion 30 and a central passageway 40 between the first and second portions 28 and 30, wherein the passageway 40 is configured to receive a portion of an ethernet cable. Upon insertion of the inner body 18 into the outer body 12, the volume of the central passageway 40 is reduced diametrically to grip a portion of an ethernet cable. The first and second clamp portions 28 and 30 may be hingedly coupled to the inner body 18. This hinged attachment allows for the portions to clamp onto an ethernet cable as force is applied to the first and second portions 28 and 30 such that the clamp portions 28 and 30 are pressed toward each other. This force may be generated by inserting the inner body 18 into the outer body 12 wherein the size of the recess or opening within the outer body 12 forces the clamp portion 28 and 30 toward each other in order for the inner body to be fully inserted within the outer body 12.

It will be understood that the clamp 20 is not limited to the clamp portions 28 and 30 as shown in FIG. 3, but may be another type of clamp 20 such as, but not limited to, a fastener, a catch, a clasp, a clench, a grip, a hold, a lock, a press, a snap and a vice so long as the ethernet cable is securely gripped and that the clamping action is actuated by the inserting of the inner body 18 within the outer body 12.

Figure 4:
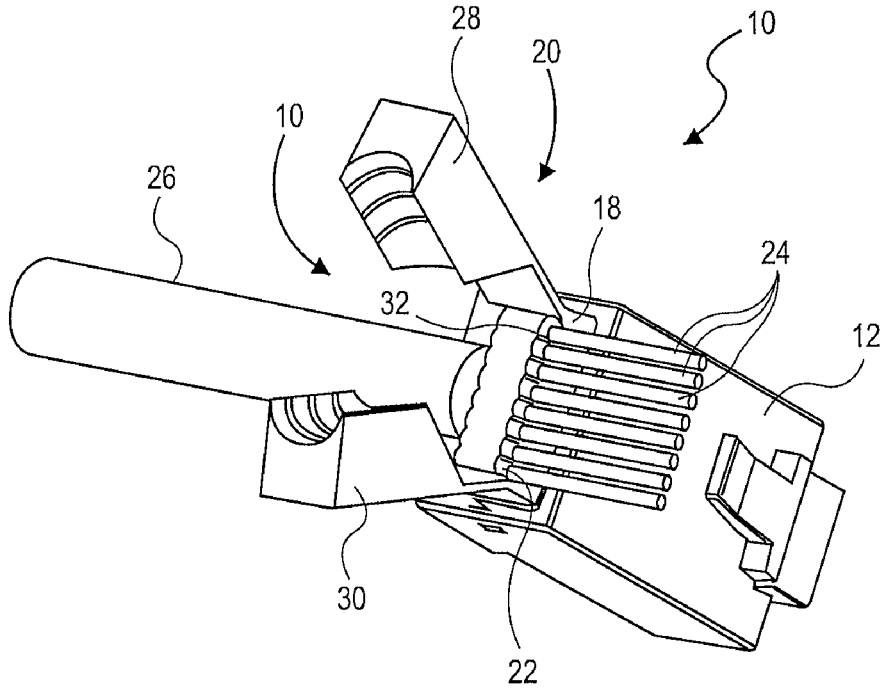
FIG. 4 depicts a perspective view of an ethernet cable being coupled to an embodiment of an ethernet cable connector, in accordance with the present invention.
Figure 5:
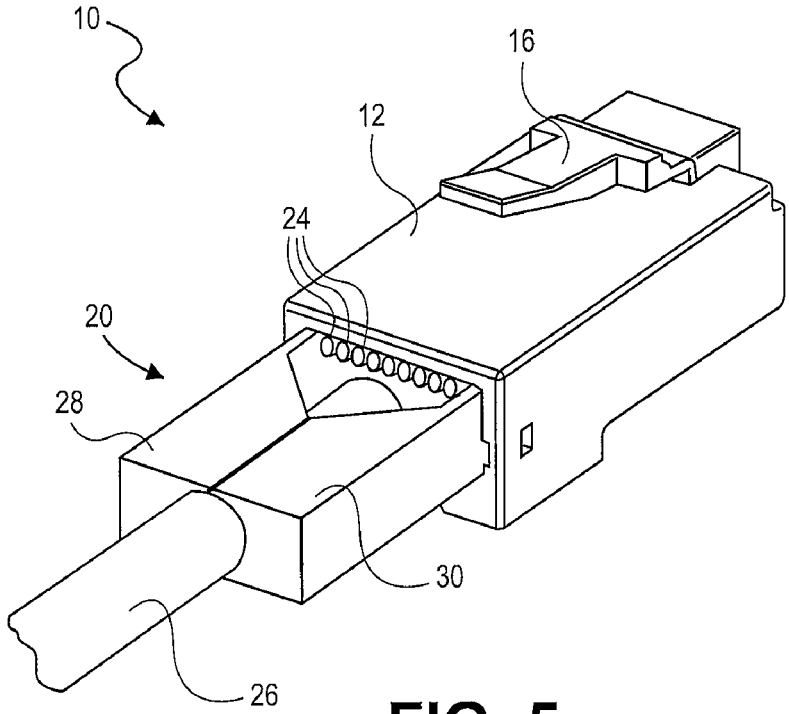
FIG. 5 depicts a perspective view of an embodiment of an ethernet cable connector with an inner body partially inserted within an outer body, in accordance with the present invention.
Figure 6:
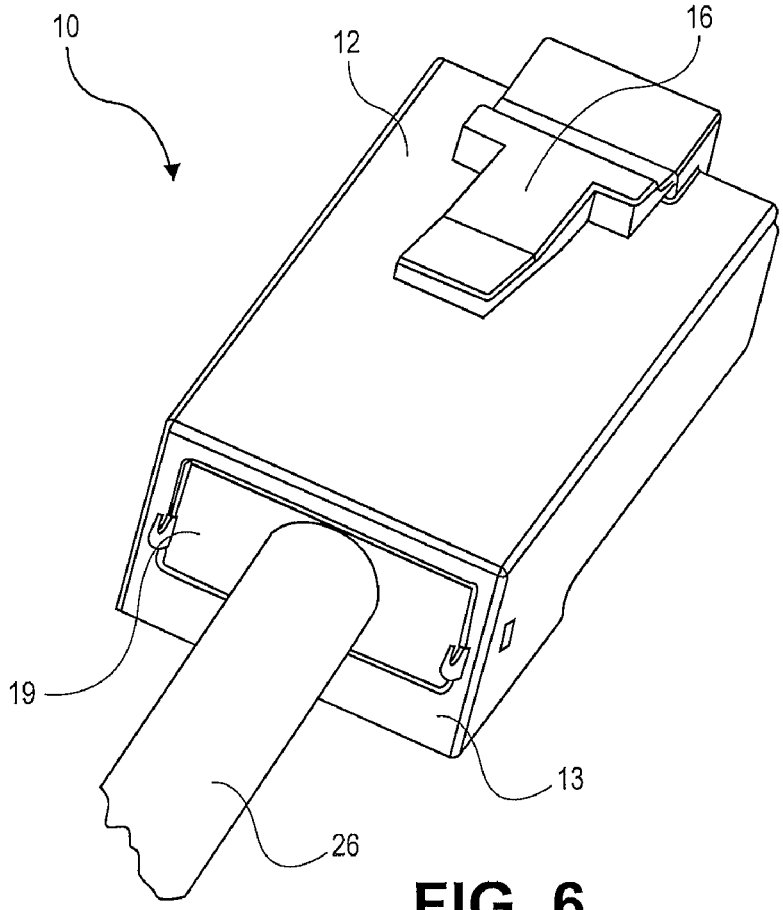
FIG. 6 depicts a perspective view of an embodiment of an ethernet cable connector with an inner body fully inserted within an outer body, in accordance with the present invention.

With further reference to the drawings, FIGS. 4-6 depict coupling of an ethernet cable connector 10 to an ethernet cable 26. The ethernet cable 26 comprises insulated wires 24. The connector 10 comprises an outer body 12 and an inner body 18. The inner body 18 may have a first end 19 and second opposing end 21, the second end 21 having a plurality of holes 22 and a plurality of recesses 32 transverse to the plurality of holes 22. The first end 19 of the connector 10 may include a clamp 20, holes 22, recesses 32 and bottom recesses 33. The clamp 20 may include a first clamp portion 28, a second opposing clamp portion 30 and a central passageway 40 between the first and second portions 28 and 30, wherein the passageway is configured to receive a portion of the ethernet cable 26. The outer body 12 is operatively coupled to the inner body 18, the outer body 12 having a first end 13 and second opposing end 15, the first end 13 having a recess or opening and the second end 15 configured to couple insulation displacement contacts (IDC's) 14 within the outer body 12. The recess or opening of the first end 13 of the outer body 12 may be configured to receive the inner body 18.

The wires 24 are received by the plurality of holes 22. The number of holes 22 is determined by the ethernet cable 26. The number of holes may be adapted to various types of ethernet cables 26 having a particular number of wires 24. For the exemplary purposes of this disclosure, and not viewed as a limitation, the ethernet cable may be a category five or a category six ethernet cable, wherein the ethernet cable has eight wires 24 and the connector 10 has eight holes 22, recesses 32 and bottom recesses 33 corresponding to the wires 24.

Once the wires 24 are received by the holes 22, the wires 24 may be trimmed to remove any excess wire, such as, but not limited to, wires that are excessive in length and may inhibit the proper insertion of the inner body 18 within the outer body 12. The inner body 18 may then be inserted within the outer body 12. The insertion of the inner body 18 within the outer body 12 bends the wires 24 of the ethernet cable 26 to rest within the plurality of recesses 32 of the inner body 18, such that the wires 24 extend transverse and away from the holes 22, as seen in FIG. 5. It will be understood that the bending of the wires 24 does not require an additional action, but is accomplished with the insertion of the inner body 18 within the outer body 12. As further seen in FIG. 5, the insertion of the inner body 18 into the outer body 12 may further engage the clamp 20 onto the ethernet cable 26, wherein the clamp 20 diametrically grips the ethernet cable 26 along a length to provide strain relief to the ethernet cable 26.

In particular embodiments of the present invention, and with reference to FIG. 5, the ethernet cable 26 is received within the central passageway 40 and the first clamp portion 28 and the second clamp portion 30 are forced toward each other due to the insertion of the inner body 18. The forcing of the clamp portions 28 and 30 toward each other reduces the volume of the center passageway 40 diametrically to grip the portion of the ethernet cable 26. As the inner body 18 is further inserted within the outer body 12, the grip of the clamp 20 is strengthened.

As seen in FIG. 6, when the inner body 18 is fully inserted within the outer body 12, the first end 19 of the inner body 18 is adjacent to the first end 13 of the outer body. Further, the second end of the inner body 21 and the second end 15 of the outer body are also adjacent such that the IDC's 14 engage the insulated wires 24. The engagement of the IDC's 14 may further include cutting the insulation of the plurality of wires 24 to make mechanical and electrical contact with the plurality of wires 24. Additionally, the inner body 18 is secured within the outer body 12 when the inner body 18 is fully inserted. It will be understood by those of ordinary skill in the art that the inner body 18 may be secured within the outer body 12 in various ways, including, but not limited to, a press fit, a clip, a compliant clip, a tab, a lock and any combination thereof. Once the inner body 18 is fully inserted within outer body 12, the connector 10 is ready for use and may be inserted within an ethernet jack, with the locking tab 16 removably locking the connector 10 within the jack.

In various embodiments of the present invention, strain on the wires 24 of the ethernet cable 26 may be reduced by means for coupling the ethernet cable 26 to the inner body 18 when the inner body 18 is received by the outer body 12. The means may include an initial location of wires 24 in holes 22 such that a portion of each of the wires 24 extends beyond the surface of the inner body 18. Moreover, the means may include the location of wires with recesses 32 when the inner body 18 is received by the outer body 12, via the bending of the wires 24 through insertable operation of the inner body 18. Furthermore, the means may include the secure retention of the cable 26 at a location along the external length of the cable by a clamp portion 20 of the inner body 18 compressed against and securely retaining the cable 26 when the inner body 18 is received by the outer body 12. Hence the wires 24 have reduced strain, inter alia, because the cable 26 is retained by the secure compressed position of the clamp portion 20 when the inner body 18 is received by the outer body 12.

Figure 7:
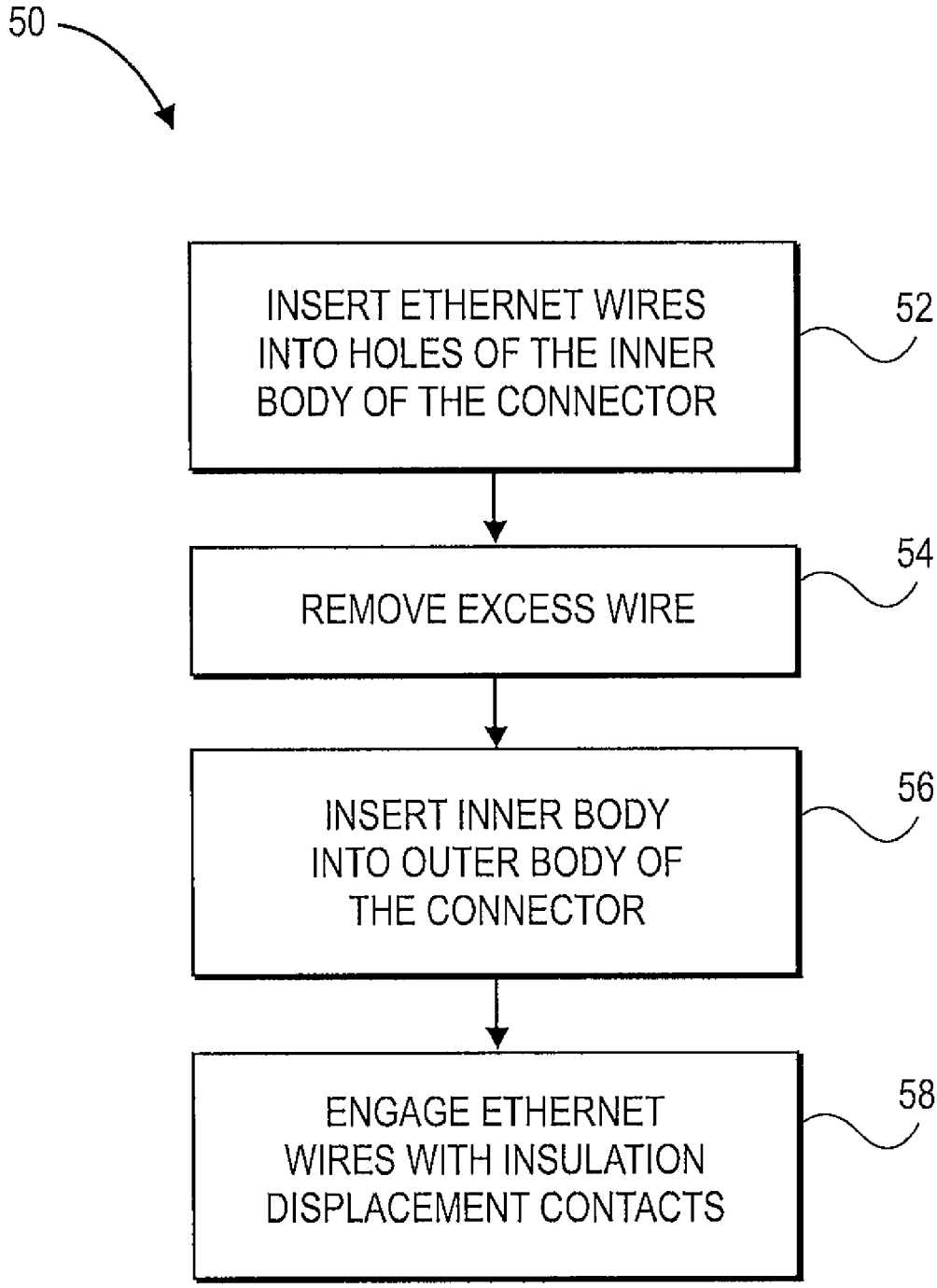
FIG. 7 depicts a flow chart of an embodiment of a method of use of an ethernet cable connector, in accordance with the present invention.

Referring further to the drawings, FIG. 7, depicts a method 50 of use of an ethernet cable connector. The method may comprise a step of providing an ethernet connector comprising in inner body and an outer body. Moreover, the method may include the steps of inserting insulated ethernet wires into holes of an inner body of a connector (Step 52), removing excess wire (Step 54), inserting the inner body of the connector into an outer body of the connector (Step 56), wherein the action of inserting the inner body into the outer body of the connector includes bending a portion of the insulated ethernet wires into a transverse position to rest within recesses and compressing a clamp of the inner body onto the ethernet cable and engaging the ethernet wires with insulation displacement contacts when the inner body is inserted into the outer body (Step 58). The sub-step of Step 56 of clamping a clamp onto an ethernet cable may further include gripping the ethernet cable diametrically along a portion of the ethernet cable and providing strain relief by gripping a length of the cable. Step 58 of method 50 of engaging the ethernet wires with insulation displacement contacts may further include cutting the insulation and contacting the conductive wire mechanically and electrically.

Figure 8:
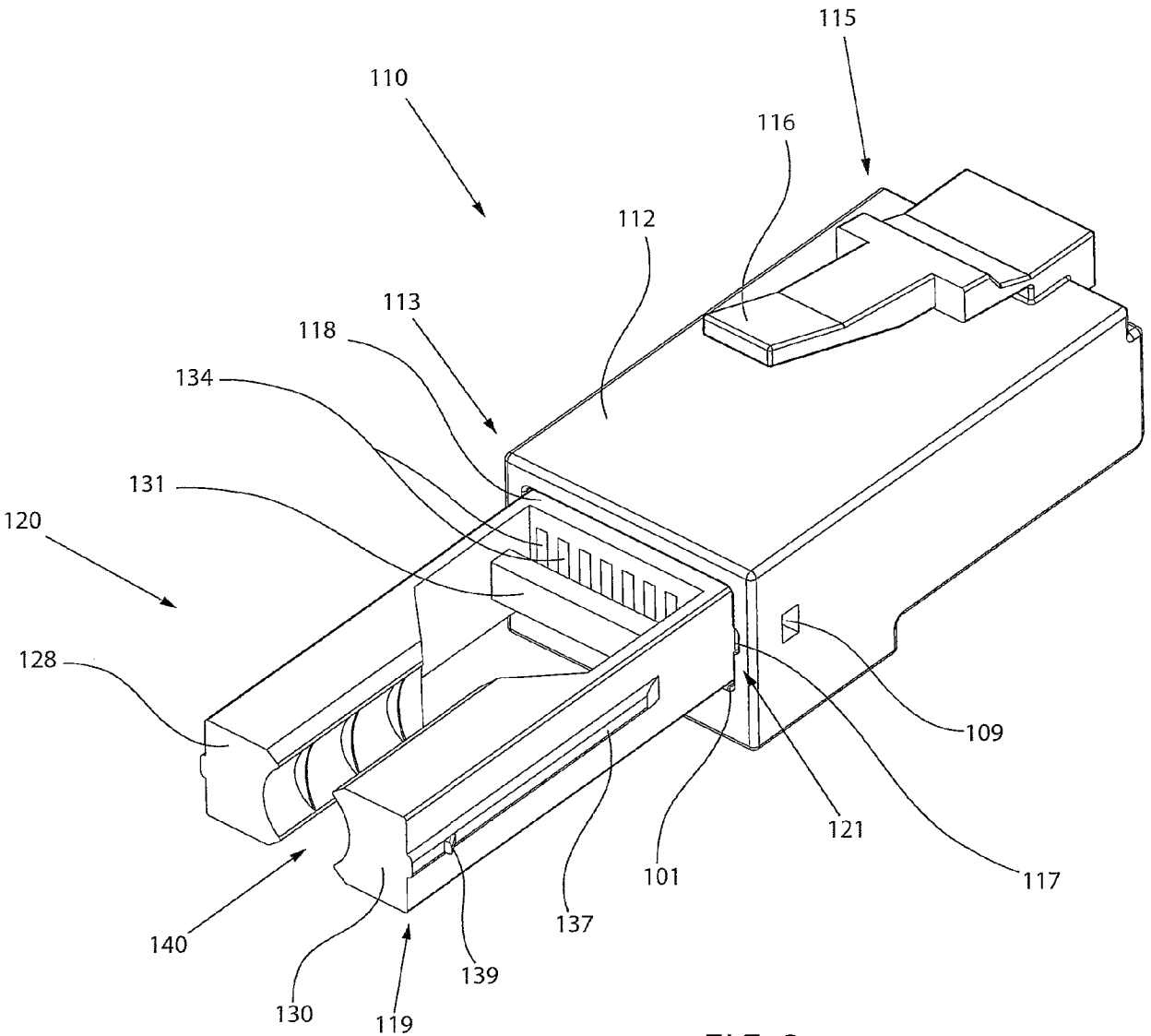
FIG. 8 depicts a perspective view of another embodiment of an ethernet cable connector, in accordance with the present invention.

FIG. 8 depicts another embodiment of an ethernet cable connector 110. The ethernet cable connector 110 includes an outer body 112 having a first end 113 and an opposing second end 115. The first end 113 includes a recess or opening 101 to receive an inner body 118. A locking tab 116 may be attached proximate the second end 115 of the outer body 112. The inner body 118 may include a first end 119 having a clamp 120. The clamp comprises two clamping portions 128 and 130 that can be bent together to form a center passageway or hollow 140. The two clamping portions 128 and 130 can be bent open, similar to the clamping portions 28 and 30 shown in FIG. 1, or bent together, as is shown in FIG. 8, to form the center passageway or hollow 140 into which an ethernet cable 26 (see FIGS. 4-6 and 10-12) may be securely located. The clamp 120 can be squeezed around the ethernet cable 26 to help connect the cable 26 to the connector 110.

Figure 9:
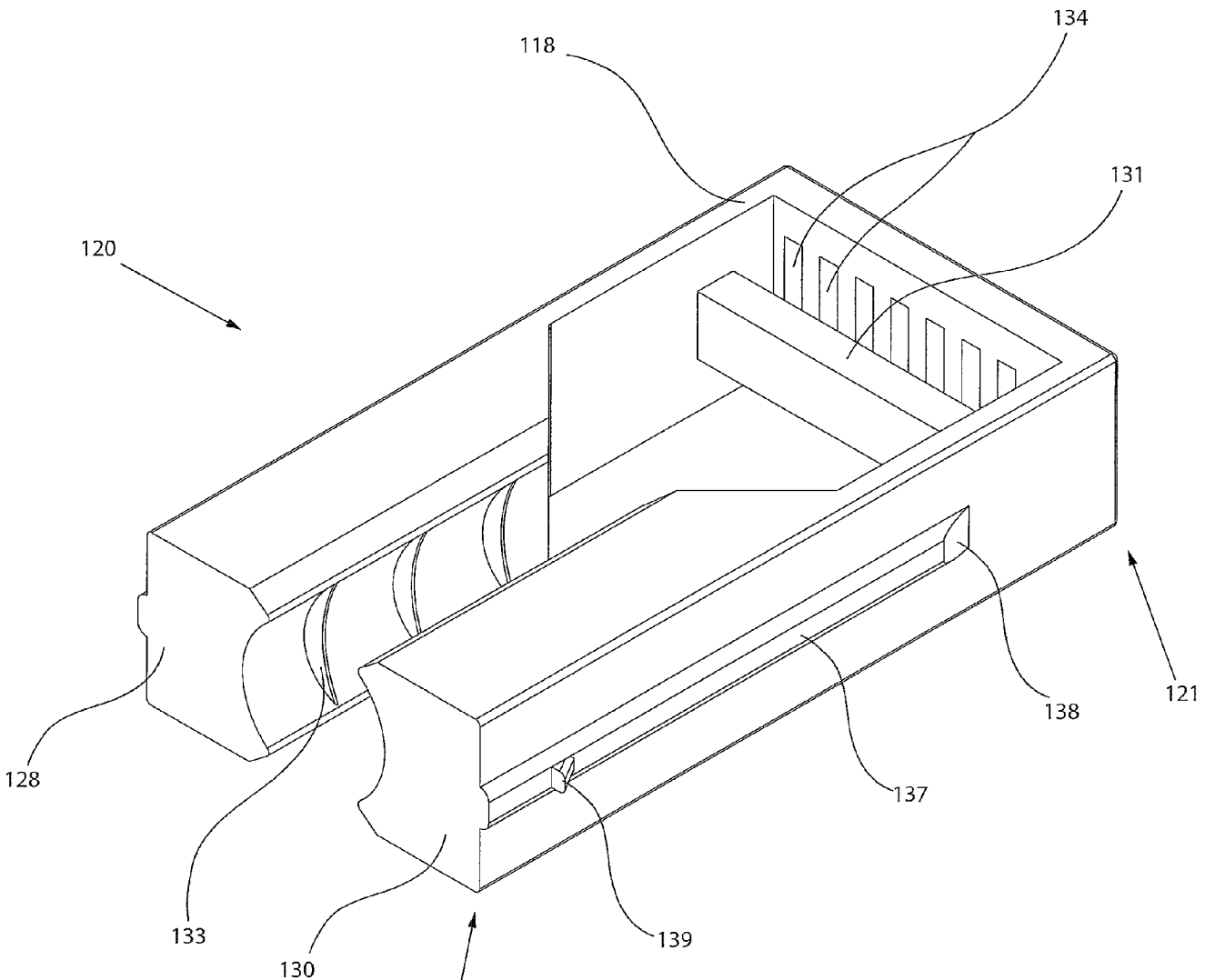
FIG. 9 depicts a perspective view of another embodiment of an inner body of an ethernet cable connector, in accordance with the present invention.

As depicted in FIGS. 8-9, an inner body 118 includes a series of access apertures 134 extending through a front face 136 of a second end 121 of the inner body 118. A guide rail 137 may reside on either side of the inner body 118. The guide rail(s) 137 may fit with corresponding guide slot(s) 117 located on either side of the recess or opening 101 of the first end 113 of the outer body 112. The joint operation of the guide rail(s) 137 and guide slot(s) 117 may help to align the inner body 118 as it is inserted within the outer body 112. Included on or otherwise operable with each guide rails 137 are locking tab(s) 139. The locking tabs 139 may engage lock slots 109 on each side of the outer body 112 to help retain the inner body 118 within the outer body 112, once the inner body 118 is fully inserted within the outer boy 112. In addition, the guide rails 137 may include a ramped forward edge 138 to help the guide rails 137 reach alignment with the guide slots 117. One or both of the clamping portions 128 and 130 of the clamp 120 may include cable engagement features 133 formed to help retain the cable 26 once clamped into the center passageway or hollow 140.

Figure 12:
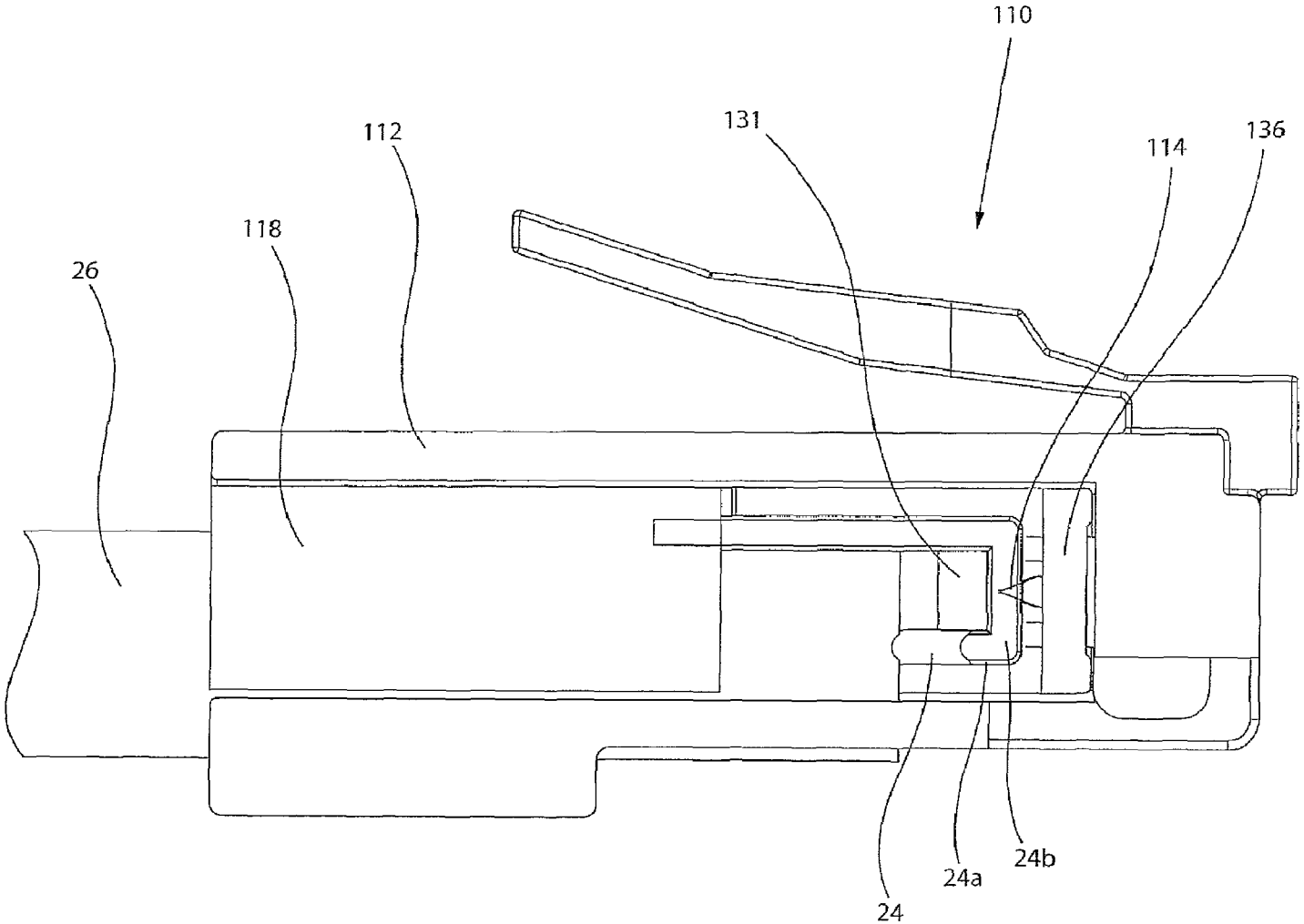
FIG. 12 depicts a side cut-away view of another embodiment of an ethernet cable connector with an inner body fully inserted within an outer body, in accordance with the present invention.

A guide member 131, may be located proximate the access apertures 134 of the second end 121 of the inner body 118, such that wires 24 (shown in FIGS. 4-5 and 10-12) may pass below the guide member 131, between the guide member 131 and the front face 136, and above the guide member 131, as the inner body 118 is located within the outer body 112 (see FIG. 12). The guide member 131 may be formed integrally with the inner body 118 or may be separately attached to the inner body 118. Moreover, the guide member 131 may include surface features, such as ridges, gullies, depressions, grooved, channels, slots, etc., designed to guide and align the wires 24 as the wires 24 interact with the guide member 131 and IDC's 114 (see FIG. 12).

Figure 10:
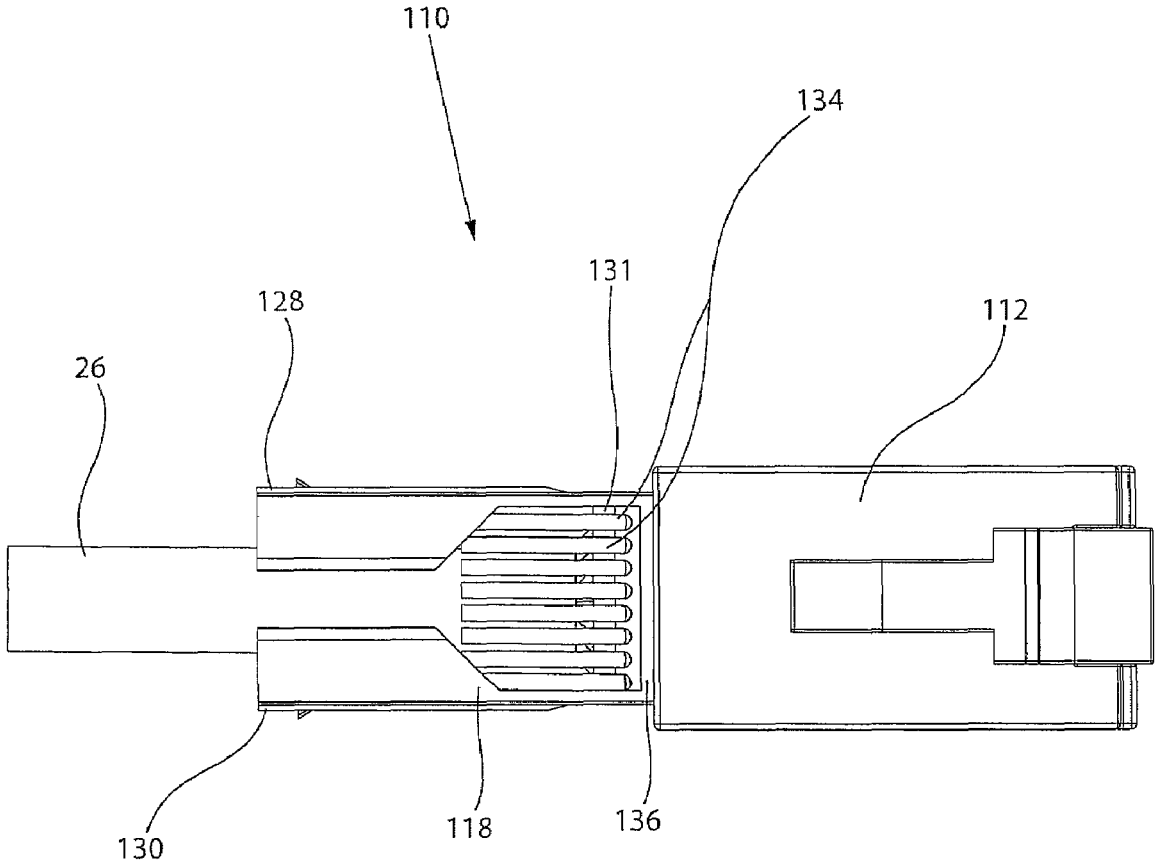
FIG. 10 depicts a top view of an ethernet cable being coupled to another embodiment of an ethernet cable connector, in accordance with the present invention.
Figure 11:
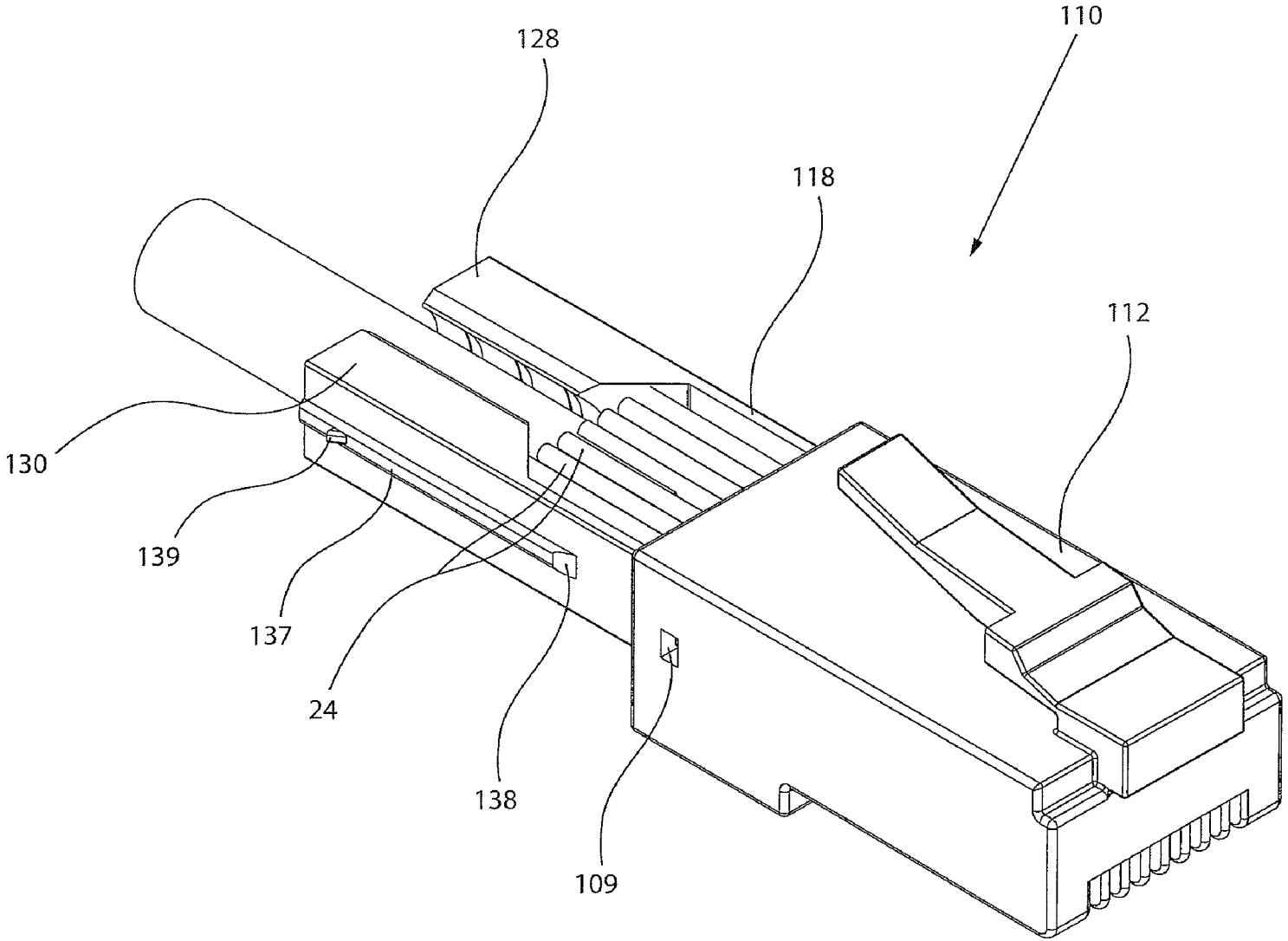
FIG. 11 depicts a perspective view of another embodiment of an ethernet cable connector with an inner body partially inserted within an outer body, in accordance with the present invention.

FIG. 10 depicts a top view of an ethernet connector 110. As shown, clamping portions 128 and 130 may be compressed around cable 26. Wires 24, from twisted pairs of the cable 26 may be aligned so as to pass under the guide member 131, between the guide member 131 and the front face 136 of the inner body 118, and over the guide member 131, being bent back toward the clamping portions 128 and 130. However, the wires may be cut and positioned similar to that shown in FIGS. 4-5, wherein the wires 24 extend upward between the guide member 131 and the front face 136 and are then bent downward toward the clamping portions 128 and 130 as the inner body 118 is inserted within the outer body 112. Accordingly, the insertion operation may bend the wires 24 down into place.

The inner body 118 may be inserted within the outer body 112. As the inner body 118 is inserted within the outer body 112, the clamping portions 128 and 130 may be compressed against the cable 26 to help retain the cable 26. Moreover, the ramped forward edge 138 helps the guide rails 137 reach accurate alignment with the guide slots 117. Once fully inserted, the locking tabs 139 may snap into the lock slots 139. To remove the inner body 118 from the outer body 112, tools or other implements may be provided and inserted into the lock slots 109 to help disengage the locking tabs 139 from the lock slots 109.

As shown in a cut-away side view of the connector 110, the guide member 131 helps locate the wires 24 for contact with IDC's 114. The IDC's are located within the outer body 112 proximate the second end 115 of the outer body 112. When the inner body 118 is fully inserted into the outer body 112, contact tips of the IDC's 114 located within the outer body 112 pass through the access apertures 134 of the front face 136 of the inner body 118. The IDC's pierce the insulating layer 24*b* of the wire 24 and make contact with the conductive interior of the wire 24. The guide member 131 helps orient the wires 24 vertically with respect to the IDC's. The IDC's 114 pierce the twisted wire pairs 24 to make electrical contact therewith as the twisted wire pairs 24 are aligned vertically against the guide member 131. The wires 24 of the ethernet cable 26 wrap partially around a guide member 131 of the inner body 118 and make electrical contact with IDC's 114 located inside the outer body 112 when the inner body 118 is inserted within the outer body 112. Because the wires 24 are oriented vertically with respect to the IDC's 114, physical and electrical contact may be maintained even if the wires 24 and cable 26 as pulled out of secure retention with the inner body 118. For example, if the cable 26 was pulled away from the connector 110 in a direction opposite insertion of the inner body 118 into the outer body 112, the wires 24 would help resist the pull because of the wrapped orientation of the wires 24 partially around and with respect to the guide member 131. Moreover, if the ethernet cable 26 is pulled away from the connector 110, movement of the wires 24 does not necessary disengage the wires 24 from contact with the IDC's. Rather, the wires 24 would slide vertically for a period, while the IDC's continued to pierce the insulator of the wires 24 and make slicing electrical contact. Hence, the contact of the wires 24 with the IDC's in a vertical arrangement also helps to retain the cable 26 and wires 24 in electrical contact with the IDC's even in the face of unwanted movement of the cable away from the connector 110, because of the extra force it would take to slice through the wires 24 when they were pulled vertically past the IDC's 114. Means for attaching the ethernet cable 26 to the connector 100 include placing the wires 24 in a partially wrapped configuration around the guide member 131 and piercing the wires 24 by the IDC's 114 when the wires 24 are in a vertical alignment between the guide member 131 and the front face 136 of the inner body 118. Furthermore, the connector 110 utilizes an orientation of ethernet cable wires 24 wrapped at least partially around at least one component, being the guide member 131, of the inner body 118 to firmly hold the cable 26 in the connector 110.

While the present invention has been described and illustrated herein with respect to preferred embodiments, it should be apparent that various modifications, adaptations and variations may be made utilizing the teachings of the present disclosure without departing from the scope of the invention and are intended to be within the scope of the present invention. In light of the foregoing, it will now be appreciated by those skilled in art that modifications may be made to the disclosed embodiments without departing from the spirit and scope of the invention as defined by the appended claims.

What is claimed is:

1. A connector for coupling an end of an Ethernet cable having twisted wire pairs, the connector comprising:

an inner body having a first end and a second opposing end, the second end having a guide member located proximate a series of access apertures extending through a front face of the inner body, and the first end having a clamp;

an outer body, having a first end and a second opposing end, the first end having an opening configured to receive the inner body;

insulation displacement contacts located within the outer body proximate the second end of the outer body;

wherein, when the inner body is inserted into the outer body, the clamp closes around the Ethernet cable and the insulation displacement contacts extend through the access apertures and pierce the wires of the twisted wire pairs, to make electrical contact therewith, as the wires are aligned vertically against the guide member; and wherein when the wires are vertically aligned against the guide member, the wires also extend from the cable and are located under the guide member, vertically located between the guide member and the front face, and located over the guide member being bent back toward the clamp.

2. The connector of claim 1, wherein the inner body includes a guide rail and the outer body includes a corresponding guide slot.

3. The connector of claim 1, wherein clamp includes cable engagement features.

4. The connector of claim 1, wherein inner body includes a locking tab and the outer bodying includes a corresponding lock slot.

5. The connector of claim 2, wherein the guide rail includes a ramped forward edge.

6. An Ethernet cable connector comprising:

an outer body having an opening configured to receive an inner body, the inner body having a front face;

wherein insertion of the inner body into the outer body compresses two clamping portions of the inner body against the ethernet cable;

wherein wires of the Ethernet cable wrap partially around a guide member of the inner body and make electrical contact with insulation displacement contacts located inside the outer body when the inner body is inserted within the outer body; and wherein, when the wires wrap partially around the guide member, the wires are located under the guide member, vertically located between the guide member and the front face, and located over the guide member being bent back toward the clamping portions.

7. The connector of claim 6, wherein the inner body further includes a plurality of access apertures through which the insulation displacement contacts extend when the inner body is inserted within the outer body.

8. The connector of claim 6, wherein the inner body includes guide rails and the outer body includes corresponding guide slots.

9. The connector of claim 6, wherein at least one of the two clamping portions includes a cable engagement feature.

10. The connector of claim 6, wherein inner body includes a locking tab and the outer bodying includes a corresponding lock slot.

11. An Ethernet cable connector comprising:

an inner body having a front face;

an outer body configured to receive the inner body;

means for attaching the ethernet cable to the connector, wherein the means utilize an orientation of ethernet cable wires wrapped at least partially around at least one component of the inner body to firmly hold the cable in the connector; and wherein, when the wires wrap partially around the at least one component or the inner body, the wires are located under the at least one component, vertically located between the at least one component and the front face, and located over at least one component being bent backward away from the front face.

12. A method of retaining an Ethernet cable in an Ethernet cable connector, the method comprising:

providing an Ethernet cable connector, the connector including:

an outer body configured to receive an inner body, the inner body having a guide member and a compressible cable clamp;

wrapping wires of the Ethernet cable partially around the guide member so that the wires reside below the guide member and run vertically between the guide inserting the inner body into the outer body so that the insertion thereof bends the wires over the top of the guide member back toward the clamp and compresses the clamp of the inner body against to cable to retain the cable within the connector.

13. The method of claim 12, further comprising piercing the wires running vertically between the guide member and the front face of the inner body by insulation displacement contacts housed within the outer body, the insulation displacement contacts extending through access apertures of the inner body when the inner body is inserted into the outer body.

14. The method of claim 12, wherein the inner body includes locking tabs and the outer body includes lock slots, so that the locking tabs of the inner body snap into place and engage the lock slots of the outer body when the inner body is inserted into the outer body.

* * * * *

UNITED STATES PATENT AND TRADEMARK OFFICE

CERTIFICATE OF CORRECTION

PATENT NO. : 7,484,993 B2
APPLICATION NO. : 11/696860
DATED : February 3, 2009
INVENTOR(S) : Amidon et al.

It is certified that error appears in the above-identified patent and that said Letters Patent is hereby corrected as shown below:

Column 10
Line 14 claim 10 delete "bodying" and insert -- body --
Line 39 claim 12 insert -- member and a front face of the inner body; and --
Line 43 claim 12 delete "to" and insert -- the --

Signed and Sealed this

Second Day of June, 2009

JOHN DOLL
*Acting Director of the United States Patent and Trademark Office*